US005231377A

United States Patent [19]

Clark

[11] Patent Number: 5,231,377

[45] Date of Patent: Jul. 27, 1993

[54] ELECTRONIC CLOSE DAMPER ALERT UNIT

[76] Inventor: Richard V. Clark, 163 South St. #22, Danbury, Conn. 06810

[21] Appl. No.: 746,971

[22] Filed: Aug. 19, 1991

[51] Int. Cl.[5] ..... G08B 21/00

[52] U.S. Cl. ..... 340/584; 126/500; 126/536; 340/540; 340/586; 340/588; 340/595

[58] Field of Search ..... 340/584, 586, 540, 588, 340/595; 126/500, 536

[56] References Cited

U.S. PATENT DOCUMENTS

| | | | |
|---|---|---|---|
| 2,393,482 | 1/1946 | Smith | 126/295 |
| 4,350,142 | 9/1982 | Beyer et al. | 126/536 |
| 4,712,095 | 12/1987 | Georgis, II | 340/584 |
| 4,916,436 | 4/1990 | Silliman et al. | 340/586 |
| 4,928,668 | 5/1990 | Reusch, Sr. | 126/285 R |

*Primary Examiner*—Glen R. Swann, III

[57] ABSTRACT

A portable unit indicates the precise time to close a fireplace damper door. The unit comprises a housing including a power source, and an electronic circuit, and an external heat sensor. The arrangement is such that the heat sensor is placed near the firebox and senses that a fire has been lit by the heat given off. The electronic circuit then stores this information and waits until the heat is no longer present. At this time, a fire extinguished indication is displayed, and a time delay circuit activated. If a fire is restarted before the delay circuit times out, the fire extinguished status is cleared and the process started over. If a fire is not restarted, and the delay circuit does time out, then a audible indication warns that the fireplace damper can now be manually closed to save energy.

22 Claims, 4 Drawing Sheets

ELECTRONIC CLOSE DAMPER ALERT UNIT

BACKGROUND OF THE INVENTION

This invention relates to a portable device which indicates exactly when to manually close a fireplace damper door. Because people often forget to close the damper door and/or do not know the right time to close it, heat escapes up the chimney flue. This results in reduced home heating efficiency.

Presently, there are indicators that tell whether the damper is open or closed, all of which use mechanical levers and screws directly coupled to the damper for means of indication. Also, these devices only indicate an open or closed status. They do not tell precisely when to close the damper. example, U.S. Pat. No. 4,928,668 discloses a device including an indicator lamp which is electrically coupled to the damper door opening lever. When the damper is open, the light is on, and vice versa. One still could leave the damper door open if they were not looking directly at the fire and the present indication. Also, one would still not know exactly when to close the damper for maximum heating effiency. Another such device is disclosed for example, in U.S. Pat. No. 2,393,482 wherein a meter indicates damper position. Here the same problems exist. Both devices are costly and very difficult to install.

SUMMARY OF INVENTION:

The present invention is directed to a portable, self contained, electronic device which indicates exactly when to close a firebox damper door. The device comprises, in combination a heat sensor means, a circuit for establishing a reference or comparison temperature, a circuit for storage of temperature differences, a circuit to detect a change in stored temperature, a fire extinguished indicating means, a reset circuit in the case of a restarted fire, a time delay circuit, and a means for producing an output signal which indicates exactly when to close the damper door.

The device works by comparing the temperature in or around the firebox to a reference temperature (house plus offset temperature). If the temperature in the firebox is greater, a fire has been lit. The unit then stores this information and waits until the fire has been extinquished. When this occurs, the firebox temperature goes lower than the reference. A indication of this status is displayed and a time delay circuit is activated. If an increase in firebox temperature occurs, the unit resets itself. If the firebox temperature remains lower and the delay circuit times out, then an indication to warn that the damper door is open is sounded.

DESCRIPTION OF THE PREFERRED EMBODIMENTS

Figure 5:
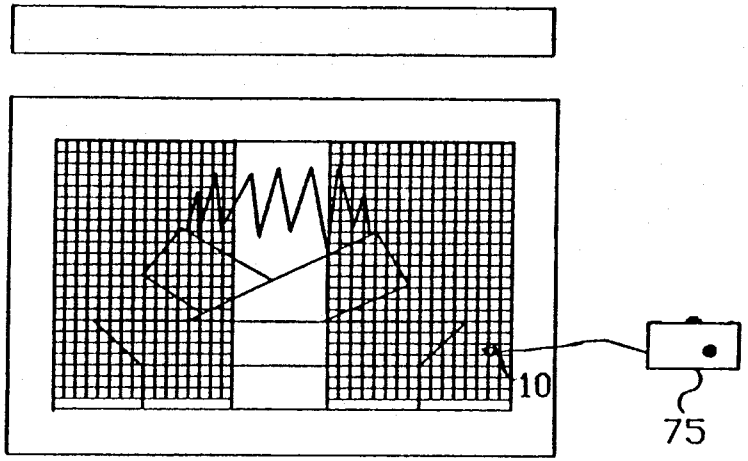
FIG. 5 shows the device connected to a fireplace.

Referring to FIG. 5 there is shown a firebox with a damper door located within the firebox. After a fire is lit, one could either forget to close the damper and/or not close it at the right time. However, if the electronic alert device according to the invention and generally shown at 75 is placed near the firebox, and sensor 10 placed into the lower part of the glass doors or screen, then this problem can be avoided.

Figure 1:
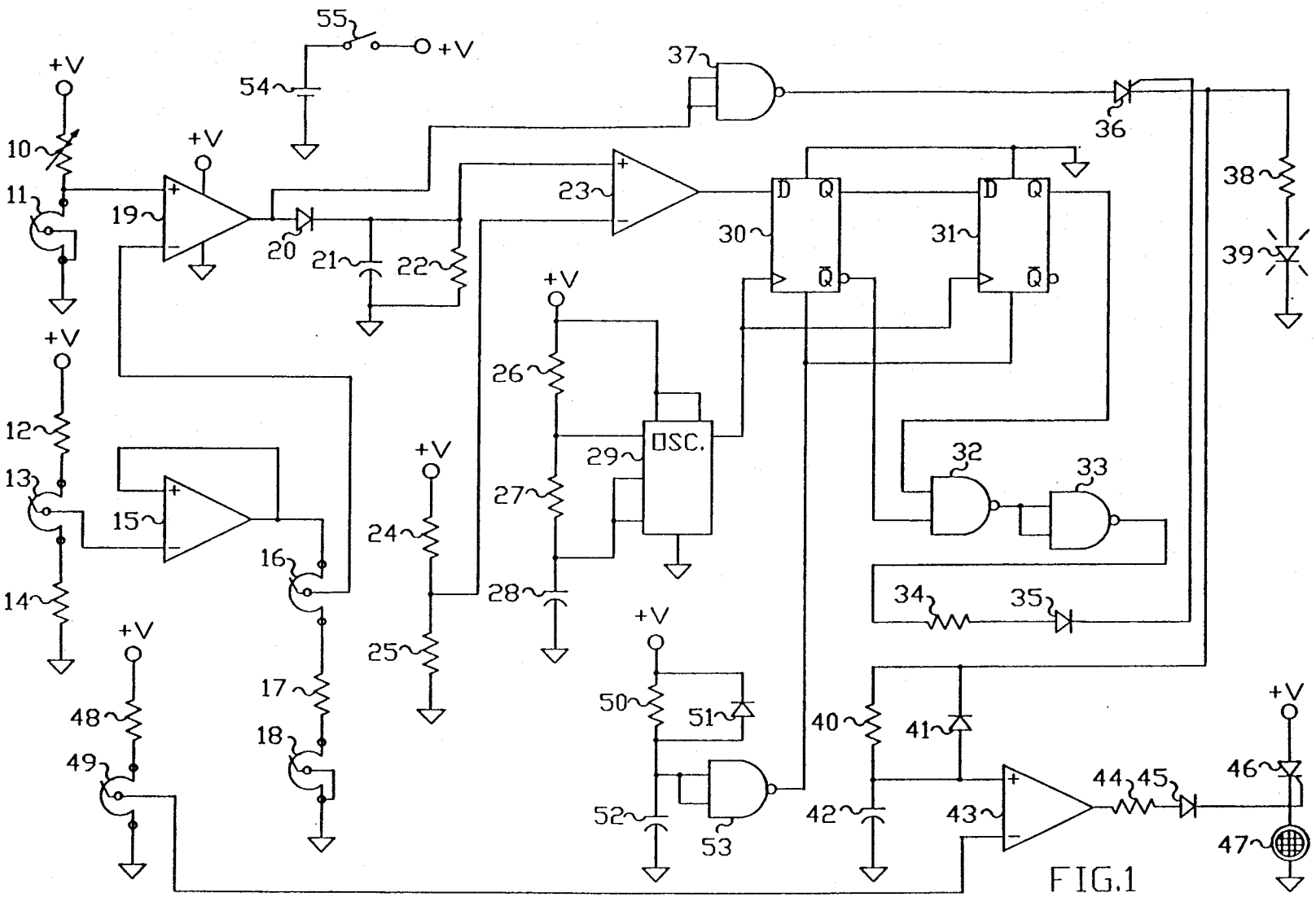
FIG. 1 is a schematic view of an electronic device according to one embodiment of the invention.

In accordance with the present invention, there is provided a means of giving an audible warning of when to close a damper door. The circuit diagram of a first embodiment of the device is shown in FIG. 1. The overall object of the close damper alert unit is to sense that the firebox is at the right temperature so that one can be warned to close the damper door for maximum home heating effiency. The heat sensor 10 which is placed near or in the firebox is shown in FIG. 1. This heat sensor changes resistance as a function of temperature. If rheostat 11 is placed in series with sensor 10, then a voltage divider is formed when the circuit is connected as viewed.

Operational amplifier (op-amp) 19 then compares this firebox divider voltage to a house plus offset voltage. The house potentiometer 16 has a range of from fifty to ninety degrees fahrenheit. The circuit components 12,13,14 and 15 provide a voltage reference which represents the house plus offset temperature at a house temperature of ninety degrees. The circuit components 17 and 18 provide a voltage reference which represents the house plus offset temperature at a house temperature of fifty degrees. When the firebox voltage exceeds the house plus offset voltage, the output of 19 swings from ground to +V. The current flow from 19 then charges capacitor 21 through diode 20. It also sends the output of 37 to swing from +V to ground. As 21 builds up charge, the output of 23 swings from ground to +V. The register 30 and 31 are both cleared (logic 0) prior to any action. However, when the output of 23 swings to +V the register upon the first low to high transition of oscillator 29 shifts from a logic 00 to a logic 10. Upon the second transition of the oscillator the register shifts again from logic 10 to a logic 11. All shifting occurs from right to left. The register, now loaded with a logic count of 11, waits until the firebox voltage goes below the reference.

With this occurance, the output of 19 swings to ground and the output of 37 swings to +V. The time delay formed by the discharging of 21 through 22 ensures that 37 is at +V before the register content is changed. Shortly after the voltage from discharging 21 and 22 falls below the voltage reference established by 24 and 25, the output of 23 swings to ground. The register content which is a logic 11 changes to a logic 01 upon the first transition of the oscillator 29. The decoder circuit, formed by gates 32 and 33, swings it's output to +V. This sends a current flowing through 34 and 35 which fires into the gate of SCR 36. SCR 36, upon receiving it's firing signal, latches up and allows the fire extinguished light 39 and variable time delay (40,41,42) to become active. On the next pulse from oscillator 29, the register content (30,31) changes again from a logic 01 to 00. The decoder circuit (32,33) then resumes back to it's original output state of ground. This stops current flowing into the gate of SCR 36.

If the firebox voltage should exceed the reference before capacitor 42 reaches it's threshold voltage set by 48 and 49, then the output of 19 swings to +V which causes 37 to release the latch on 36 and thus to turn off LED 39. It also causes 42 to discharge back to ground through diode 41 and sets the register back to a logic 11 state. It then waits until the firebox voltage falls below the reference at which point the process of detection is started over.

If the firebox voltage remains below the reference, and resistor 40 supplies enough charge to capacitor 42 so that the voltage threshold at op-amp 43 is exceeded then the output of 43 swings from ground to +V. 44 and 45 experience this change by sending current to the gate of SCR 46. SCR 46 which becomes latched turns on audible transducer 47. The only way of clearing this indication is by opening switch 55.

Other circuit functions include that of 50,51,52 and 53. Here, when battery potential 54 is applied to +V through the closing of switch 55 (the unit is turned on), the output of 53 swings from +V to ground. This action clears register flip flops 30 and 31.

Figure 2:
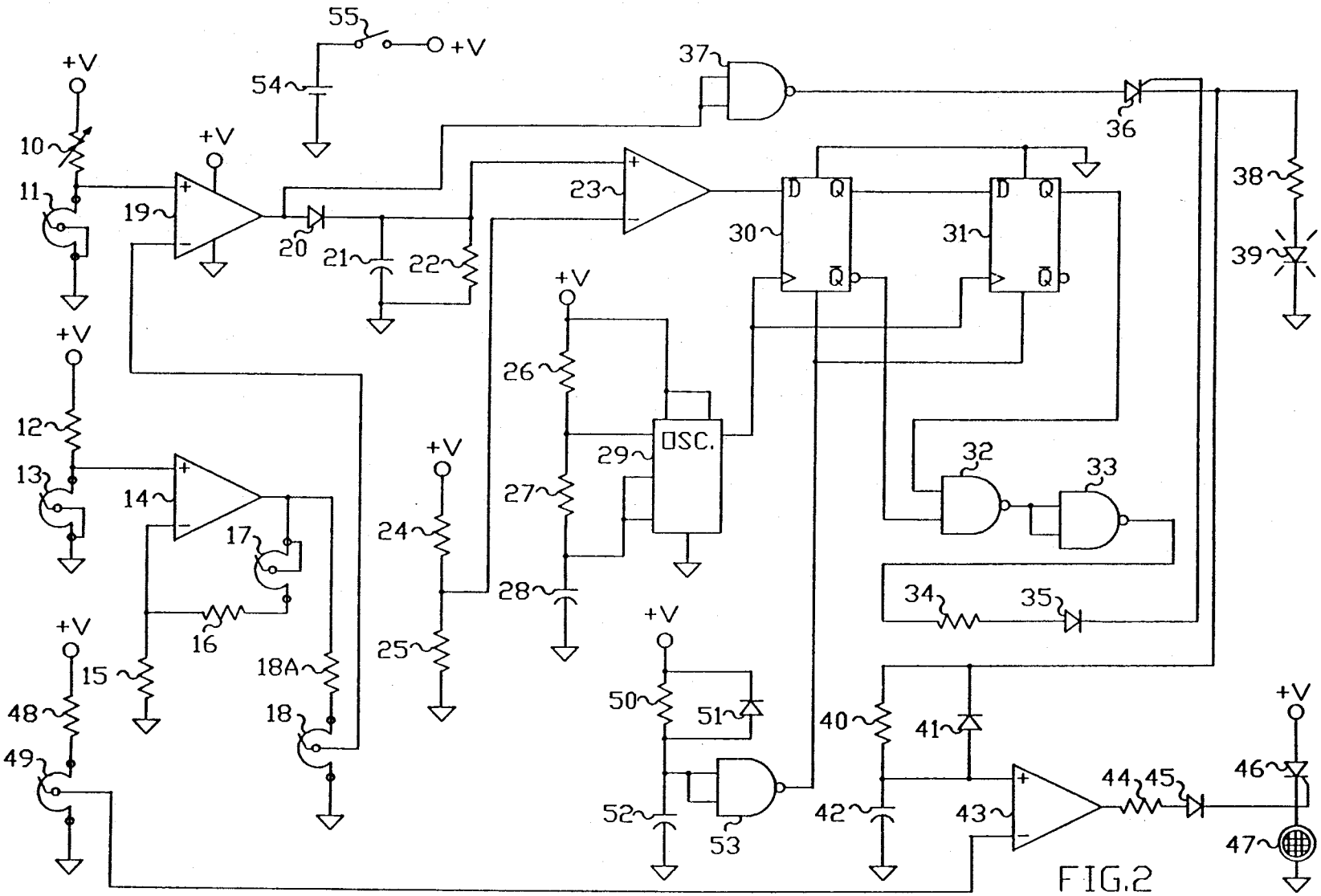
FIG. 2 is a schematic view of a similar device according to another embodiment of the invention.

Referring to FIG. 2, there is shown an alert device according to another embodiment of the invention for indicating exactly when to close a firebox damper door. As in the previous embodiment, operation of the circuit also detects changes in firebox temperature. However, this circuit uses two heat sensors and functions as follows. As shown in FIG. 2, the heat sensor 10 is placed near or in the firebox. This heat sensor changes resistance as a function of temperature. If rheostat 11 is placed in series with 10 then a voltage divider is formed when the circuit is connected as viewed. Operational amplifier (op-amp) 19 then compares this firebox divider voltage to a house plus offset voltage. The house plus offset voltage is produced by components 12,13,14,15,16,17,18, and 18*a*. Here, heat sensor 12, which functions in the same manner as 10, is located within housing 75 as shown in FIG. 5. It's purpose is to automatically read in the house temperature so that no external potentiometers have to be set (16 in FIG. 1). When 12 is placed in series with rheostat 13 a voltage divider is formed. The voltage picked off at the plus terminal of 14 represents the true house temperature. The circuit action of 14, which is a non-inverting op-amp, has a gain potentiometer 17. This sets the offset temperature voltage. Components 18 and 18*a* set a scale down factor which feeds the negative terminal of op-amp 19. When the firebox voltage exceeds the house plus offset voltage, the output of 19 swings from ground to +V. The current flow from 19 then charges capacitor 21 through diode 20. It also sends the output of 37 to swing from +V to ground. As 21 builds up charge, the output of 23 swings from ground to +V. The register 30 and 31 are both cleared (logic 0) prior to any action. However, when the output of 23 swings to +V the register upon the first low to high transition of oscillator 29 shifts from a logic 00 to a logic 10. Upon the second transition of the oscillator the register shifts again from logic 10 to a logic 11. All shifting occurs from right to left. The register, now loaded with a logic count of 11, waits until the firebox voltage goes below the reference.

With this occurance, the output of 19 swings to ground and the output of 37 swings to +V. The time delay formed by the discharging of 21 and 22 ensures that 37 is at +V before the register content is changed. Shortly after the voltage from discharging 21 and 22 falls below the voltage reference established by 24 and 25, the output of 23 swings to ground. The register content which is a logic 11 changes to a logic 01 upon the first transition of the oscillator 29. The decoder circuit, formed by gates 32 and 33, swings it's output to +V. This sends a current flowing through 34 and 35 which fires into the gate of SCR 36. SCR 36, upon receiving it's firing signal, latches up and allows the fire extinguished light 39 and variable time delay (40,41,42) to become active. On the next pulse from oscillator 29, the register content (30,31) changes again from a logic 01 to 00. The decoder circuit (32,33) then resumes back to it's original output state of ground. This stops current flowing into the gate of SCR 36.

If the firebox voltage should exceed the reference before capacitor 42 reaches it's threshold voltage set by 48 and 49, then the output of 19 swings to +V which causes 37 to release the latch on 36 and thus to turn off LED 39. It also causes 42 to discharge back to ground through diode 41 and sets the register back to a logic 11 state. It then waits until the firebox voltage falls below the reference at which point the process of detection is started over.

If the firebox voltage remains below the reference, and resistor 40 supplies enough charge to capacitor 42 so that the voltage threshold at op-amp 43 is exceeded then the output of 43 swings from ground to +V. 44 and 45 experience this change by sending current to the gate of SCR 46. SCR 46 which becomes latched turns on audible transducer 47. The only way of clearing this indication is by opening switch 55.

Other circuit functions include that of 50,51,52, and 53. Here, when battery potential 54 is applied to +V through the closing of switch 55 (the unit is turned on), the output of 53 swings from +V to ground. This action clears register flip flops 30 and 31.

Figure 3:
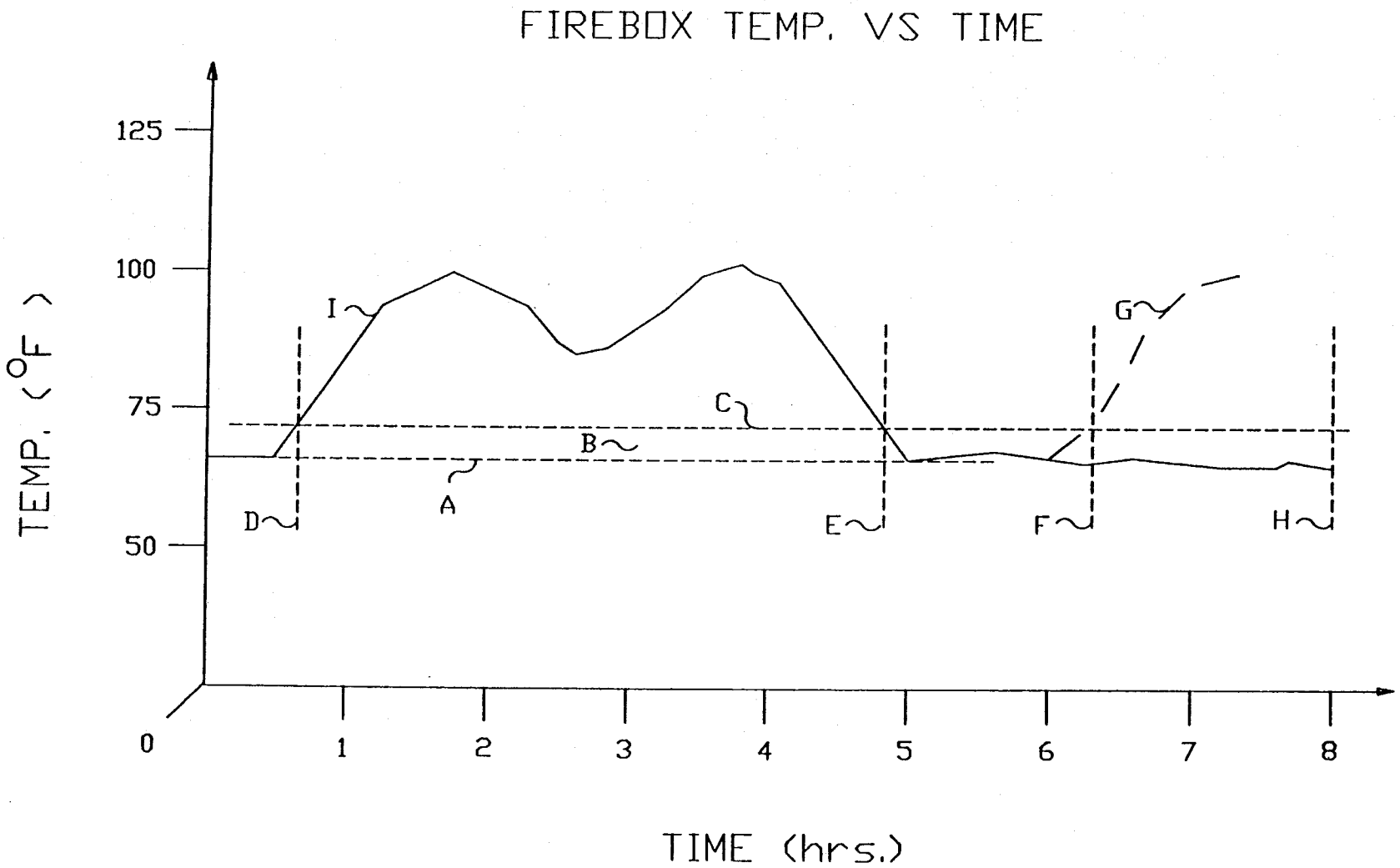
FIG. 3 shows the waveform of the change in firebox temperature verses time.

FIG. 3 shows a typical heat curve of a firebox with several key points lettered A to I. The present invention uses this curve by starting off at time zero with the house temperature A at 68 degrees Fahrenheit and firebox temperature I at the same. When a fire is lit, the fire box temperature rises. The reference temperature C, which is the summation of house A and offset B temperatures, forms a final temperature of 73 degrees F. The offset temperature B is set in this example at 5 degrees F. As I rises it passes through point D. Here is when the firebox voltage exceeds the reference and output 19 swings from ground to +V. The register, which is at a logic 11, then waits until the firebox voltage falls below the reference.

This occurs when curve I passes through point E. Now the decoder fires SCR 36 which activates the fire extinguished light and starts the variable time delay circuit of 40,41, and 42.

If the firebox temperature exceeds the reference before the delay times out, as illustrated by curve G at intersection F, then 37 releases SCR latch 36 and the LED 38 turns off. It also sets the variable time delay back to zero and returns register 30 and 31 back to a logic 11. The process of detecting point E is started over.

If the firebox temperature remains below the reference, and the delay curcuit reaches it's threshold and times out, then at point H an audible transducer is sounded.

Figure 4:
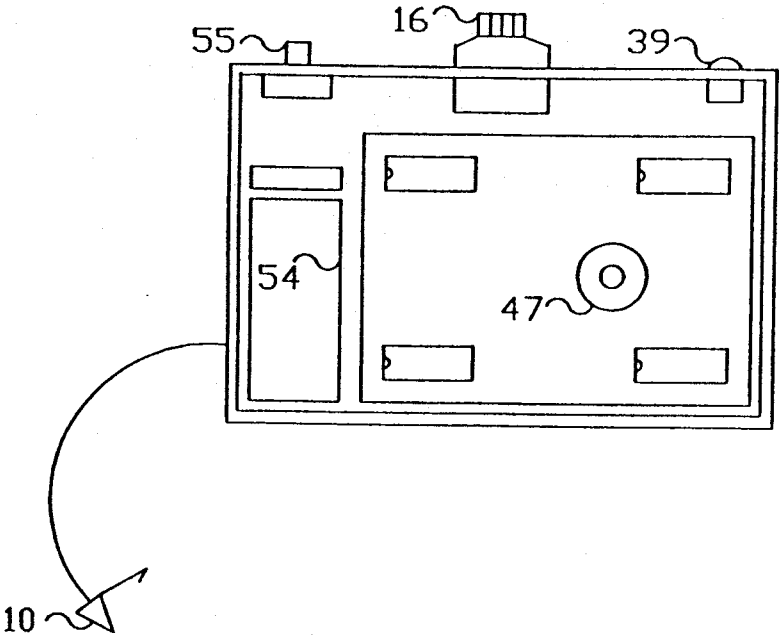
FIG. 4 shows the device embodied in a housing.

FIG. 4 illustrates the device of the invention in a housing. It shows the physical location of on/off switch 55, battery source 54, firebox heat sensor 10, house temperature potentiometer 16, fire extinguished light 39, and audible transducer 47.

The invention claim:

1. A device for indicating when to close the damper door of a firebox, comprising, in combination:

means for sensing the temperature of said firebox;

means for storing a reference temperature corresponding to the temperature at which a fire will be sustained in said firebox;

means for detecting when said firebox temperature falls below said reference temperature, indicating that the fire in said firebox has been extinguished;

means for producing a time delay upon detection of said firebox temperature falling below said reference temperature; and, means for producing an output signal upon completion of said time delay, indicating that said firebox has cooled and it is safe to close said damper door.

2. A device as defined by claim 1, further including a housing containing all of the elements of said device except said sensing means.

3. A device as defined by claim 1, further including means responsive to said detecting means for providing a visual indication that said fire has been extinguished.

4. A device as defined by claim 3, further including means for clearing said detecting means in the event that said firebox temperature rises above said reference temperature, indicating the reoccurrence of a fire in said firebox.

5. A device as defined by claim 4, wherein said detecting means includes a means for comparing said firebox temperature to said reference temperature, said comparing means comprising a threshold detector including at least one operational amplifier and a potentiometer.

6. A device as defined by claim 5, wherein said storage means comprises a flip flop register controlled by means of a clock oscillator, power reset circuit and the output of said threshold detector.

7. A device as defined by claim 6, wherein said detecting means includes a decoder composed of logic gates which latch a silicon controlled rectifier (SCR) at a predetermined count.

8. A device as defined by claim 7, wherein said visual indication means comprises a light emitting diode coupled to said silicon controlled rectifier (SCR).

9. A device as defined by claim 7, wherein said clearing means comprises an invertor gate connected to the output of said threshold detector and which releases the SCR latch and resets said flip flop register upon an increase in said firebox temperature above said reference temperature.

10. A device as defined by claim 1, further including alert means responsive to said output signal for indicating that it is safe to close said damper.

11. A device as defined by claim 1, wherein said sensing means comprises a thermistor whose resistance varies as a function of temperature.

12. A device as defined by claim 1, wherein said sensing means comprises a first sensor for sensing the temperature of said firebox and a second sensor for sensing the ambient temperature.

13. A device as defined by claim 12, wherein said first and second sensors each comprise a thermistor whose resistance varies as a function of temperature.

14. A device as defined by claim 1, wherein said time delay means comprises a resistor-capacitor network (R-C), the output of which is connected to a variable threshold detector to control the exact time delay.

15. A device as defined by claim 14, further including alert means comprising an SCR latch coupled to the output of a variable threshold detector, said variable threshold detector driving a piezoelectric type transducer to produce an audio signal indicating the correct time to close said damper door.

16. A portable, self contained, electronic device for indicating when to manually close a firebox damper door comprising, in combination;

means for sensing the temperature of said firebox;

a housing and within said housing;

means for storing a reference temperature corresponding to the temperature at which a fire will be sustained in said firebox;

means for detecting when said firebox temperature falls below said reference temperature, indicating that the fire in said firebox has been extinguished;

means coupled to said detecting means for visually indicating that said fire has been extinguished;

means for providing a time delay upon detection of said firebox temperature falling below said reference temperature, said time delay ensuring proper cooling of said firebox;

means for clearing said detecting means and said visual indicating means upon the reoccurrence of a fire in said firebox; and means for producing an output signal upon completion of said time delay, indicating that it is safe to close said damper door.

17. A device as defined by claim 16, wherein said sensing means comprises a thermistor whose resistance varies as a function of temperature and which is placed inside or in close proximity to said firebox.

18. A device as defined by claim 16, wherein said sensing means comprises first and second thermistors whose resistance varies as a function temperature, said first thermistor being placed inside or inclose proximity to said firebox and said second thermistor being exposed to the ambient temperature.

19. A method for indicating the precise time to close a firebox damper door, comprising the steps of:

(a) sensing the temperature of said firebox;

(b) storing a reference temperature corresponding to the temperature at which a fire will be sustained in said firebox;

(c) detecting when said firebox temperature falls below said reference temperature, indicating that the fire in said firebox has been extinguished;

(d) initiating a time delay upon the occurrence of step (c) in order to insure proper cooling of said firebox; and (e) producing an output signal upon completion of said time delay, indicating that it is safe to close said damper door.

20. A method as defined by claim 19, further including the step of providing a visual indication of when said firebox temperature falls below said reference temperature.

21. A method as defined by claim 19, further including the step of clearing said time delay upon the reoccurrence of a fire in said firebox.

22. A method as defined by claim 19, further including the step of producing an audible alarm upon the occurrence of said output signal.

* * * * *